US010604888B2

(12) United States Patent
Cordier et al.

(10) Patent No.: US 10,604,888 B2
(45) Date of Patent: Mar. 31, 2020

(54) STEAM IRONING APPARATUS

(71) Applicant: SEB S.A., Ecully (FR)

(72) Inventors: Thomas Cordier, Wavignies (FR); Arnaud Bochard, Lyons (FR); Jean-Pierre Lavoine, Montcarra (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 16/469,028

(22) PCT Filed: Dec. 7, 2017

(86) PCT No.: PCT/FR2017/053428
§ 371 (c)(1),
(2) Date: Jun. 12, 2019

(87) PCT Pub. No.: WO2018/109325
PCT Pub. Date: Jun. 21, 2018

(65) Prior Publication Data

US 2019/0316289 A1 Oct. 17, 2019

(30) Foreign Application Priority Data

Dec. 13, 2016 (FR) ..... 16 62358

(51) Int. Cl.
*D06F 75/14* (2006.01)

(52) U.S. Cl.
CPC ..... *D06F 75/14* (2013.01)

(58) Field of Classification Search
CPC ... D06F 75/00–24; D06F 87/00; A47G 25/72; F22B 1/28; F22B 1/282; F22B 1/284; F22B 1/285; H05B 3/40
See application file for complete search history.

(56) References Cited

U.S. PATENT DOCUMENTS 5,388,180 A * 2/1995 Bayles ..... B44C 7/027 392/396
5,704,143 A * 1/1998 Kubicz ..... D06F 75/18 38/77.83

(Continued)

FOREIGN PATENT DOCUMENTS

CN 104831510 A 8/2015
FR 2 169 206 A1 9/1973

(Continued)

OTHER PUBLICATIONS

International Preliminary Report on Patentability and the Written Opinion of the International Searching Authority as issued in International Patent Application No. PCT/FR2017/053428, dated Jun. 18, 2019.

(Continued)

*Primary Examiner* — Ismael Izaguirre
(74) *Attorney, Agent, or Firm* — Pillsbury Winthrop Shaw Pittman LLP

(57) ABSTRACT

A steam ironing apparatus including a handle connected to a steam-emitting head including a treatment surface intended for being placed vertically opposite a garment to be ironed and including at least one steam outlet opening, the steam-emitting head including a heating body including a steaming chamber including a bottom wall forming an angle of 45° to 90° with the treatment surface and including an injection system to inject liquid into the steaming chamber, wherein the injection system to inject liquid includes at least two nozzles injecting liquid onto two separate steaming areas of the steaming chamber.

17 Claims, 4 Drawing Sheets

(56) References Cited

U.S. PATENT DOCUMENTS

| | | | | | |
|---|---|---|---|---|---|
| 5,979,089 | A * | 11/1999 | Bouleau | D06F 75/20 | 38/77.83 |
| 6,031,969 | A * | 2/2000 | Burr | A47L 1/08 | 15/320 |
| 7,603,800 | B2 * | 10/2009 | Kubert | D06F 75/18 | 38/77.83 |
| 2015/0354128 | A1 * | 12/2015 | Choo | D06F 75/14 | 68/222 |

FOREIGN PATENT DOCUMENTS

| | | | |
|---|---|---|---|
| GB | 1 378 101 | A | 12/1974 |
| WO | WO 2016/090538 | A1 | 6/2016 |

OTHER PUBLICATIONS

International Search Report as issued in International Patent Application No. PCT/FR2017/053428, dated Mar. 8, 2018.

* cited by examiner

STEAM IRONING APPARATUS

CROSS REFERENCE TO RELATED APPLICATIONS

This application is the U.S. National Stage of PCT/FR2017/053428, filed Dec. 7, 2017, which in turn claims priority to French Patent Application No. 1662358 filed Dec. 13, 2016, the entire contents of all applications are incorporated herein by reference in their entireties.

This invention concerns the field of portable steam smoothing apparatuses including a handle connected to a steam-emitting head including a treatment surface intended for being placed vertically opposite a garment to be smoothed and comprising at least one steam outlet orifice. The invention relates more particularly to an apparatus in which the steam-emitting head includes a heating body comprising a steaming chamber including a bottom wall forming an angle of 45° to 90° with the treatment surface and includes means for spraying liquid into the steaming chamber.

It is known from the patent application FR 2 169 206 a steam smoothing apparatus comprising a handle surmounted by a steam-emitting head including a treatment surface equipped with a steam outlet orifice, intended for being placed vertically opposite a garment to be smoothed. In this document the steam-emitting head includes a heating body comprising a steaming chamber including a bottom wall forming an angle of approximately 90° with the treatment surface and comprises a nozzle, supplied by a pump, which allows water from the reservoir to be sprayed into the steaming chamber.

Such a smoothing apparatus is designed to be held in the hand with the handle slightly tilted toward the front, such that the steam-diffusing treatment surface is arranged vertically, opposite the garment to be smoothed, and that the bottom wall of the steaming chamber is arranged substantially horizontally.

However, the user may be tempted to tilt the head of the apparatus to one side, or even downwards, when he carries out a smoothing session. However, tilting the apparatus in this way may lead water to spatter through the steam outlet orifice at the same time as the steam, in particular when the user frequently actuates the trigger in order to obtain a high steam flow.

The following invention aims to remedy these drawbacks by proposing in particular a portable smoothing apparatus that produces a high steam flow and can be used in all positions with a limited risk of spattering of water droplets through the steam outlet orifice.

The purpose of the invention is achieved through a steam smoothing apparatus including a handle connected to a steam-emitting head including a treatment surface intended for being placed vertically opposite a garment to be smoothed and comprising at least one steam outlet orifice, the steam-emitting head including a heating body comprising a steaming chamber including a bottom wall forming an angle of 45° to 90° with the treatment surface and including means for injecting liquid into the steaming chamber, characterized in that the means for injecting liquid comprise at least two nozzles injecting liquid onto two separate steaming areas of the steaming chamber.

Such a characteristic makes it possible to inject liquid simultaneously onto two separate areas of the steaming chamber, which makes it possible to obtain faster steaming of the liquid in the steaming chamber. In particular, such a characteristic makes it possible to have a more homogeneous temperature in the steaming chamber, which promotes steam production. Finally, when the temperature of the heating body is controlled by means of the thermostat, the more homogeneous distribution of the temperature in the steaming chamber allows a faster reaction of the thermostat, which is conducive to better steaming of the water injected into the steaming chamber.

According to another characteristic of the invention, the heating body includes an electrical resistor, the power to which is controlled by means of a thermostat.

According to another characteristic of the invention, the bottom wall includes a front extremity oriented toward the treatment surface and a rear extremity situated opposite, the steaming areas being surrounded on a portion of their circumference by a retention wall that forms a cavity in which liquid can be trapped when the bottom wall is tipped vertically toward the rear or vertically to one side.

"Tipping the bottom wall vertically toward the rear" is understood to mean that the bottom wall is arranged vertically by rotating its rear extremity downwards.

"Tipping the bottom wall vertically to one side" is understood to mean that the bottom wall is arranged vertically by rotating the bottom wall about a longitudinal axis passing through the front extremity and the rear extremity of the heating body.

According to another characteristic of the invention, the steaming chamber is laterally bordered by a peripheral wall and is closed on its upper extremity by a lid attached to the peripheral wall, the lid containing the nozzles.

The steaming chamber realized in this way has the advantage of being simple and economical to make.

According to another characteristic of the invention, the peripheral wall includes an opening establishing communication between the interior of the steaming chamber and a steam distribution circuit in which the steam is diffused to the steam outlet orifice, the opening being arranged at a rear extremity of the steaming chamber arranged opposite the treatment surface.

Such a construction prevents any droplets of water stored in the steaming chamber from flowing through the steam outlet orifice when the bottom wall is tipped toward the front.

According to yet another characteristic of the invention, the retention wall extends from the peripheral wall toward the interior of the steaming chamber, passing behind the steaming area, then on the side of the steaming area, and finally at least partially in front of the steaming area, but without reaching the peripheral wall, resulting in a passage between one distal extremity of the retention wall and the peripheral wall.

According to yet another characteristic of the invention, the passages of the steaming areas communicate with a central channel for steam diffusion extending longitudinally to the center of the steaming chamber, the two steaming areas being arranged symmetrically on either side of the central channel.

Such a construction makes it possible to have a central channel which is not obstructed by the water in the steaming chamber when the bottom wall is tipped to one side.

According to yet another characteristic of the invention, the central channel discharges opposite a deflecting wall which is arranged opposite the opening, the deflecting wall diverting the steam flow from the central channel toward two lateral steam outlet channels which extend along the peripheral wall and discharge on either side of the opening.

Such a construction prevents the steam flow from the central channel from directly escaping through the opening while carrying water droplets.

According to yet another characteristic of the invention, the steaming chamber includes, at the edge of the opening, two extremity walls that project toward the interior of the steaming chamber.

Such a construction limits the risk of water leakage when the bottom wall is tipped vertically toward the rear.

According to yet another characteristic of the invention, the steaming chamber projects in the middle of an enclosure of the heating body, the enclosure defining a distribution circuit around the steaming chamber.

According to yet another characteristic of the invention, the treatment surface is borne by an extremity plate arranged at a longitudinal extremity of the head, the heating body including a front face which comes into contact with the extremity plate, the front face comprising a port putting the steam outlet hole of the treatment surface into communication with the enclosure of the heating body.

Such a characteristic allows the treatment surface to be thermally coupled to the heating body in order to maintain the temperature of the treatment surface at a temperature higher than 100° C. and prevents steam condensation on the latter.

According to yet another characteristic of the invention, the two nozzles inject liquid onto two separate steaming areas of the bottom wall of the steaming chamber.

Such a characteristic optimizes the operation of the steaming chamber when the smoothing head is arranged substantially horizontally with the handle of the apparatus oriented downwards.

According to another characteristic of the invention, the bottom wall forms an angle with the treatment surface of 75° to 90°, and preferably of approximately 90°.

Such a characteristic has the advantage of optimizing the distribution of liquid onto the bottom wall of the steaming chamber in the most common position of use of the apparatus.

According to yet another characteristic of the invention, the two nozzles are arranged symmetrically on either side of a median plane P perpendicular to the front face and to the bottom wall of the steaming chamber.

Such a characteristic makes it possible to obtain equivalent performances of the apparatus when the apparatus is tipped to either side.

According to yet another characteristic of the invention, the assembly of the steaming chamber is symmetrical with respect to the plane P.

According to yet another characteristic of the invention, the apparatus includes a portable housing comprising the head, the handle and a liquid reservoir, the steaming chamber being supplied with liquid from the reservoir by means of a pump, advantageously electric, integrated in the housing.

Such a construction makes it possible to realize a compact apparatus with very good steaming performances.

According to yet another characteristic of the invention, the pump supplies the steaming chamber with water from the reservoir with a flow of 10 to 35 gr/min, and preferably of approximately 25 gr/min.

The objects, aspects, and advantages of this invention will be more fully understood in consideration of the following description of a particular embodiment of the invention presented as a non-restrictive example, by referring to the attached drawings in which.

Only the elements necessary for understanding the invention have been represented. To facilitate reading of the drawings, the same elements bear the same references from one figure to the next.

Note that in this document, the terms "horizontal," "vertical," "lower," "upper," "front," "rear," "bottom" and "ceiling" used to describe the smoothing apparatus refer to this apparatus when it is resting flat on its feet.

Figure 1:
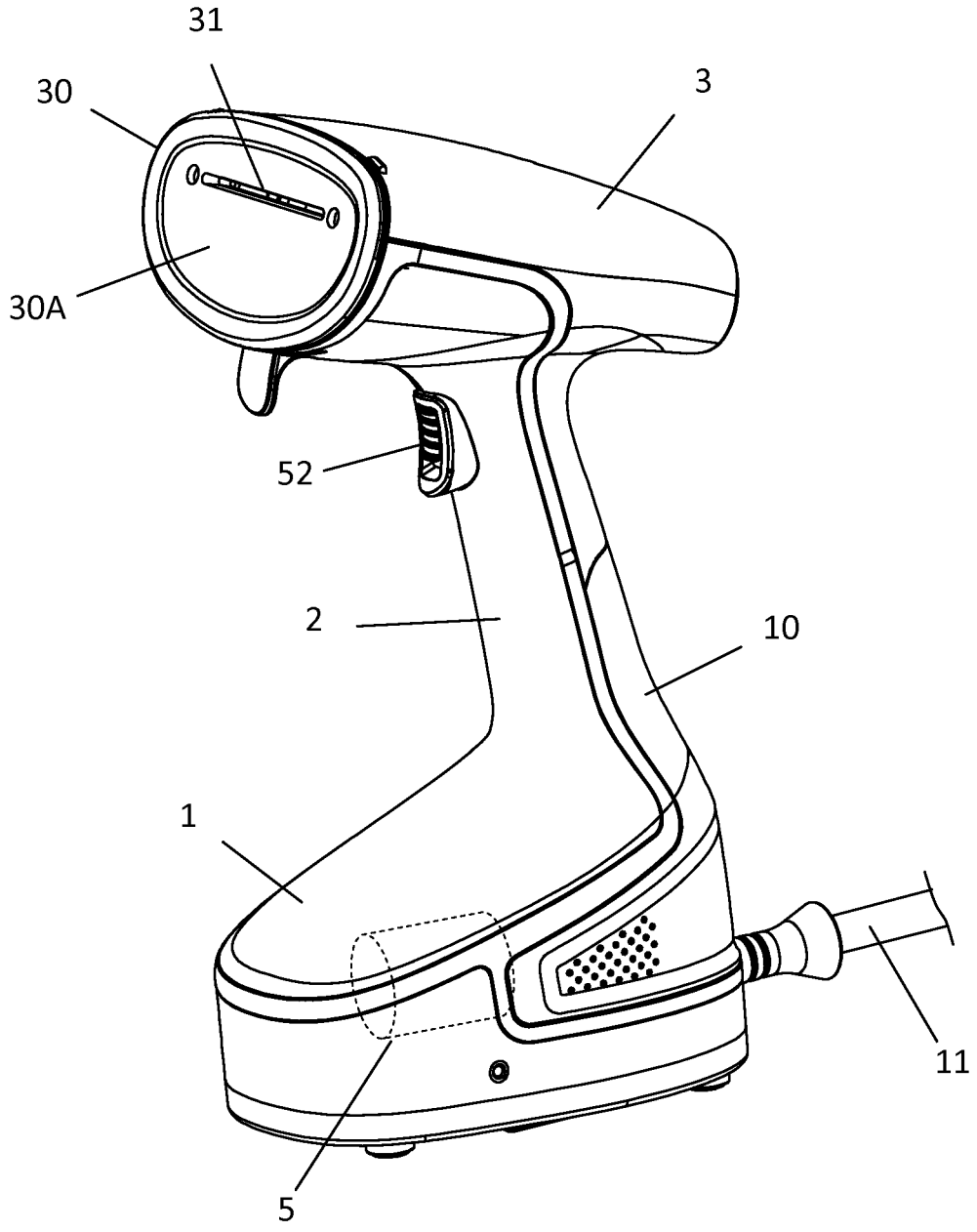
FIG. 1 is a perspective view of an ironing apparatus according to a particular embodiment of the invention.

FIG. 1 represents an ironing apparatus including a portable housing of plastic material comprising a base 1 surmounted by a handle 2 and a steam-emitting head 3, the base 1 comprising a flat lower face equipped with feet on which the apparatus can rest in a stable manner in a substantially vertical position.

Figure 2:
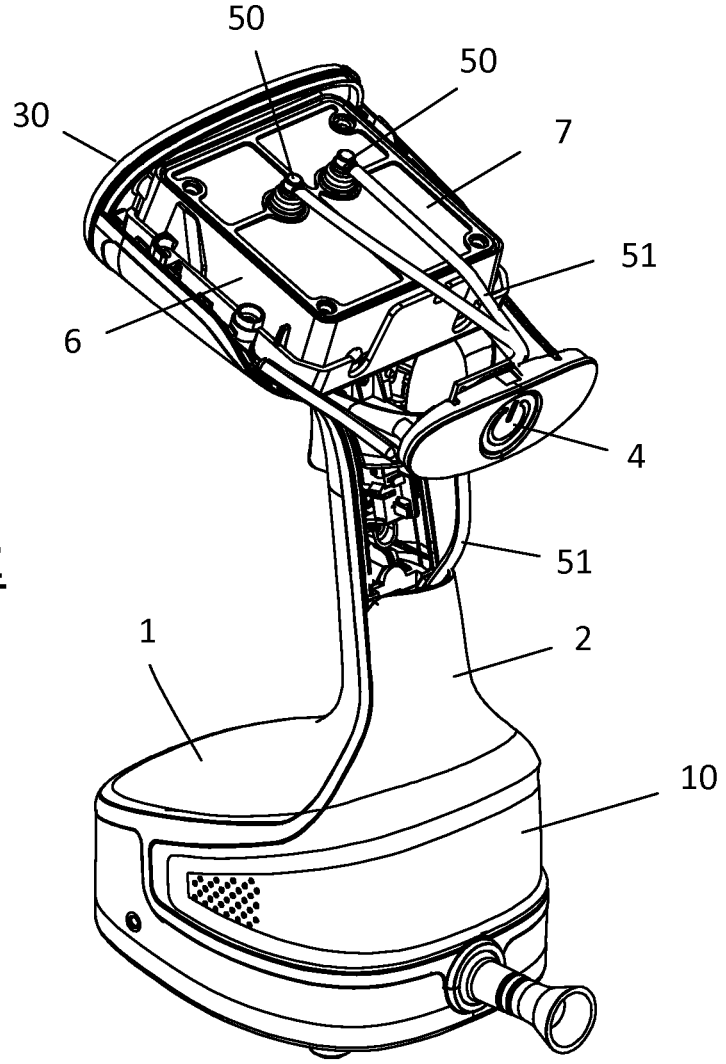
FIG. 2 is another perspective view of the apparatus in FIG. 1, without a portion of the housing covering the head of the apparatus.
Figure 3:
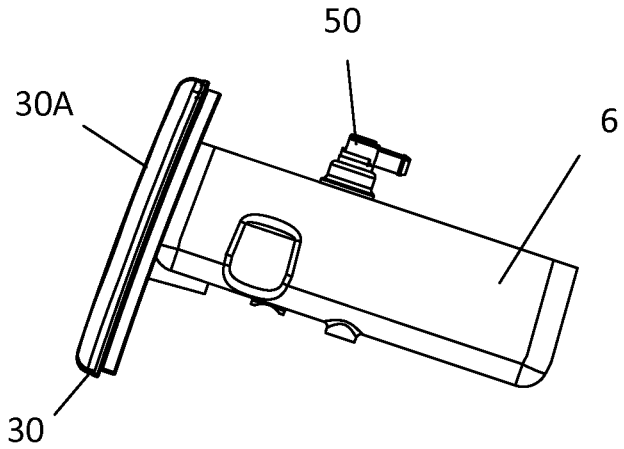
FIG. 3 is a side view of the heating body equipping the apparatus in FIG. 1, coupled to the extremity plate.

The base 1 of the apparatus includes an electric power cord 11 allowing it to be connected to a household power supply grid and the steam-emitting head 3 includes a rear face equipped with a button 4, visible on FIG. 2, allowing the apparatus to be turned on.

The base 1 contains an electric pump 5, illustrated in dotted lines on FIG. 1, whose operation is controlled by means of a trigger 52 arranged at the summit of the handle 2, the trigger 52 actuating, in a manner known per se, a switch connected to an electronic card controlling the pump 5, not represented on the figures. The pump 5 is supplied with liquid by a reservoir 10 partially arranged in the base 1 and in the lower section of the handle 2, this reservoir 10 being advantageously removable from the apparatus to facilitate filling it.

The steam-emitting head 3 has a slim shape extending transversally to the longitudinal direction of the handle 2 and includes a longitudinal extremity equipped with a flat extremity plate 30 having a treatment surface 30A intended for being placed vertically opposite the garment to be smoothed, this extremity plate 30 comprising a slot 31 for the emission of a flow of steam.

In accordance with FIG. 2, the steam-emitting head 3 contains a heating body 6 which is closed on its upper extremity by a lid 7 holding two nozzles 50 connected by a Y-shaped silicone pipe 51 to the pump 5, the heating body 6 having the general shape of a rectangular parallelepiped comprising a front face coming into thermal contact with the extremity plate 30.

Figure 4:
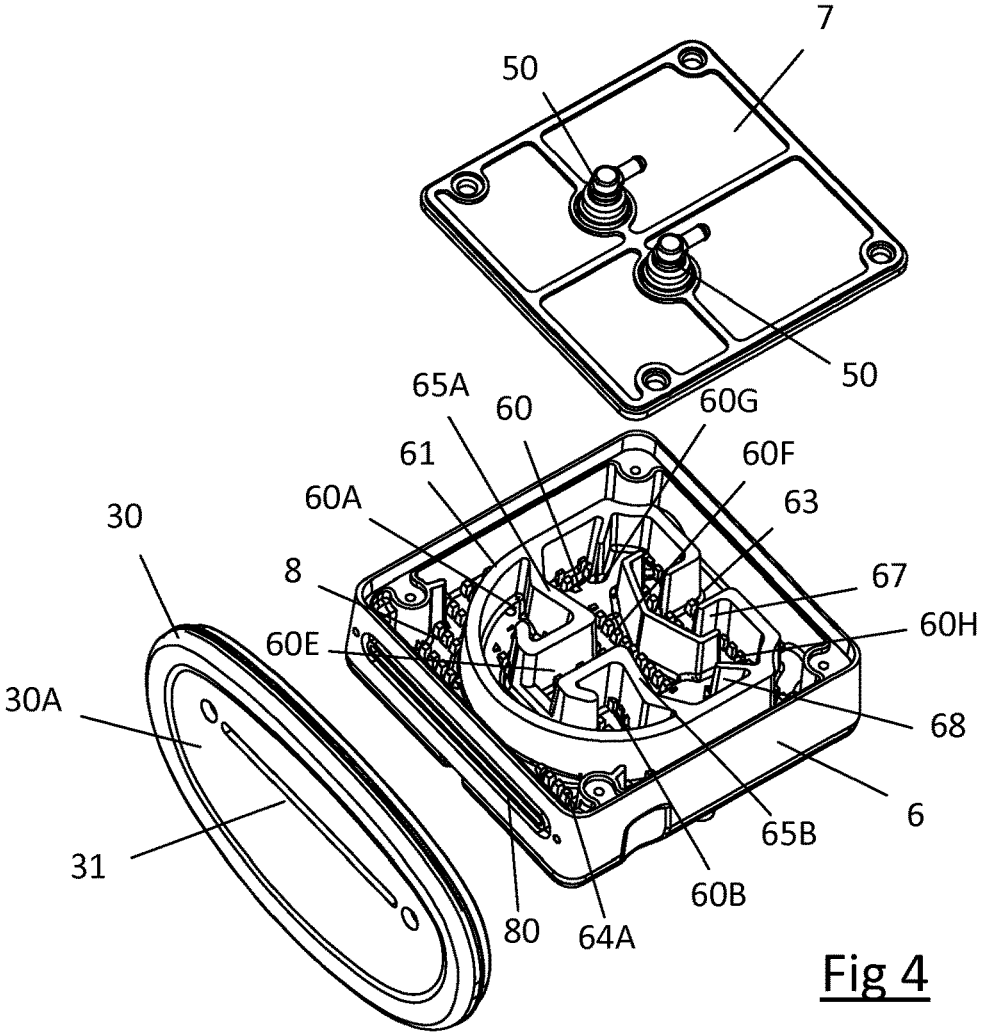
FIG. 4 is an exploded perspective view of the assembly illustrated in FIG. 3.
Figure 5:
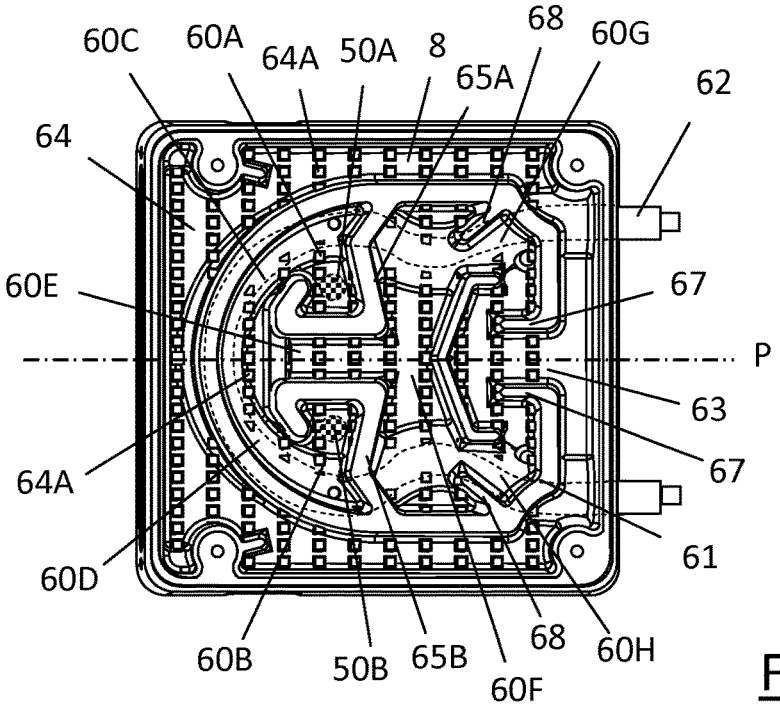
FIG. 5 is a top view of the heating body without its closing lid.

In accordance with FIGS. 4 and 5, the heating body 6 defines an enclosure at the center of which is arranged a steaming chamber 60, the latter being laterally delimited by a peripheral wall 61 having a semi-circular front extremity and a straight rear extremity, the steaming chamber 60 being closed on its upper extremity by the lid 7, the latter resting in a sealed manner on the summit of the peripheral wall 61.

Preferably, the heating body 6 consists of an aluminum casting in which is embedded an electrical resistor 62, of the type of a U-shaped shielded resistor, having power of approximately 1000 W, the power supply to the electrical resistor 62 being controlled by means of a thermostat around a setpoint temperature, measured at the center of the steaming chamber 60, of between 110° C. and 150° C. The heating body 6 can also include a fuse which cuts the electric power supply to the electrical resistor 62 in the event of failure of the thermostat, such a fuse being able to act, for example, when the temperature of the heating body 6 exceeds 250° C.

The enclosure of the heating body 6 includes, outside the peripheral wall 61, a volume which defines a distribution circuit 8, on either side of the steaming chamber 60, in which the steam may flow toward a port 80 arranged in the front face of the heating body 6, visible in FIG. 4, this port 80 having a shape corresponding to the shape of the steam-emitting slot 31 of the treatment surface 30A of the head 3.

The steaming chamber 60 communicates with the steam distribution circuit 8 through an opening 63 arranged at a rear extremity of the steaming chamber 60, the steam exiting through this opening 63 being able to flow into the steam distribution circuit 8 on either side of the steaming chamber 60 to then be diffused through the slot 31.

As can be seen on FIG. 5, the heating body 6 includes a bottom wall 64, having multiple projecting studs 64A, which constitutes at the same time the bottom wall of the steam distribution circuit 8 and the bottom wall of the steaming chamber 60, the latter having two steaming areas 60A, 60B opposite the two nozzles 50 borne by the lid 7, the water coming from the nozzles 50 being sprayed onto the bottom wall 64 at an injection area 50A, 50B illustrated by a checkered circle.

Preferably, the two nozzles 50, as well as the two associated steaming areas 60A, 60B, are arranged symmetrically with respect to a longitudinal plane P extending perpendicularly to the front face and to the bottom wall 64 of the steaming chamber 60.

Figure 6A:
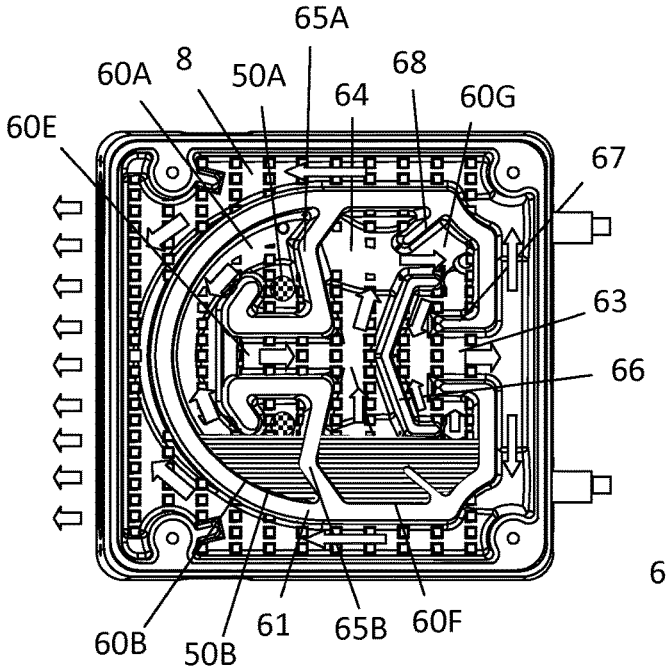
FIGS. 6A to 6C are views of the heating body when the latter is arranged vertically according to different positions.
Figure 6B:
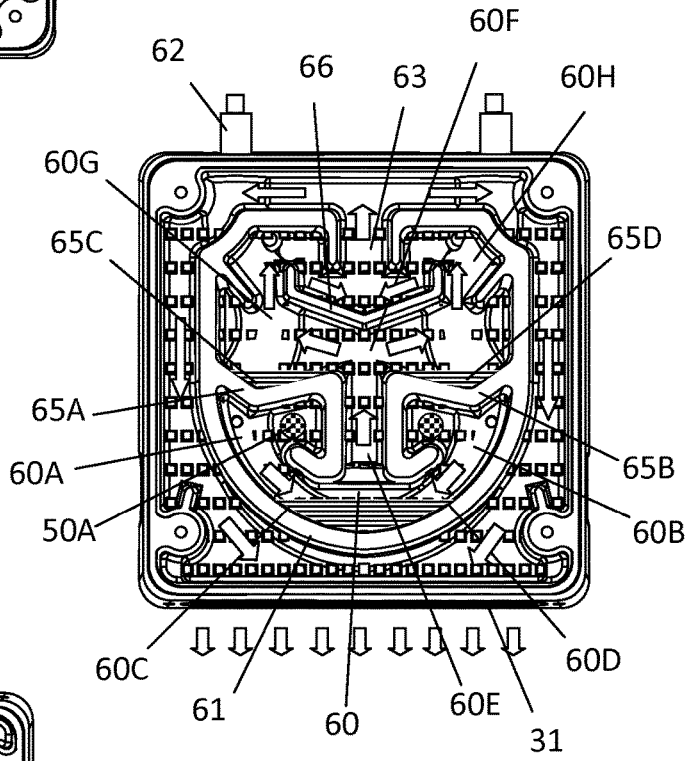
Figure 6C:
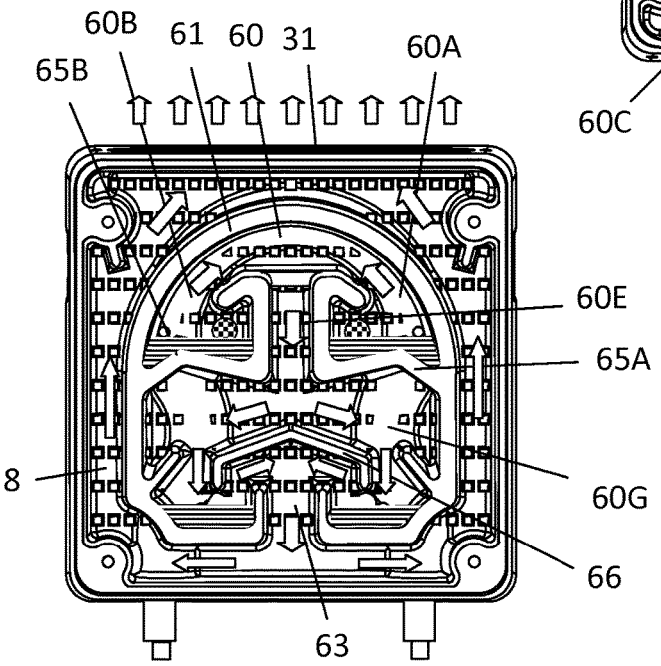

The steaming chamber 60 includes for each of the two steaming areas 60A, 60B, a retention wall 65A, 65B which surrounds the steaming area 60A, 60B on a portion of its circumference, the retention wall 65A, 65B forming a cavity around the steaming area 60A, 60B in which liquid can be trapped when the bottom wall 64 is tipped vertically toward the rear, that is, by rotating its rear extremity downwards, as illustrated in FIG. 6C, but also when the bottom wall 64 is tipped vertically to one side, that is, by rotating the bottom wall 64 about a longitudinal axis passing through the front extremity and the rear extremity of the heating body 6, as illustrated in FIG. 6A.

Preferably, the two retention walls 65A, 65B extend symmetrically with respect to the plane P, each retention wall 65A, 65B originating on the peripheral wall 61 and comprising a first section following the rear edge of the steaming area 60A, 60B, by extending globally in a plane perpendicular to the plane P, then a second section following the steaming area 60A, 60B, extending longitudinally toward the front extremity of the steaming area 60, and a third section which is curved toward the interior of the steaming area 60A, 60B and has a distal extremity which is separated from the peripheral wall 61 by a passage allowing steam to escape.

The third section of the retention wall 65A, 65B extends substantially parallel to the peripheral wall 61 and delimits with the latter a circular front channel 60C, 60D which connects the steaming area 60A, 60B to a central channel 60E arranged between the two sections of the retention walls 65A, 65B, this central channel 60E discharging into a rear cavity 60F arranged behind the first section of the retention wall 65A, 65B.

Preferably, the first section of the retention wall 65A, 65B has a shape curved toward the interior of the steaming area 60A, 60B which forms a cavity 65C, 65D in which liquid, illustrated by a series of horizontal lines on FIG. 6B, can be stored when the steaming chamber 60 is arranged vertically with its front extremity oriented downwards.

In the example illustrated, the curved shape is obtained by giving an angular shape to the first section of the retention wall 65A, 65B, the latter having two straight sections which merge at an angle projecting toward the interior of the steaming area 60A, 60B.

The rear cavity 60F of the steaming chamber 60 advantageously includes a deflecting wall 66 which is arranged in the middle of the rear cavity 60F, opposite the opening 63, the deflecting wall 66 diverting the steam flow from the central channel 60E toward two lateral channels 60G, 60H which follow the first sections of the two retention walls 65A, 65B and then the peripheral wall 61 by winding around the deflecting wall 66.

Preferably, the deflecting wall 66 includes two straight sections which together form a salient angle, of approximately 140°, facing the central channel 60E, the two straight sections being prolonged by two terminal sections extending toward the rear of the steaming chamber 60, parallel to the longitudinal axis of the steaming chamber 60.

The lateral channels 60G, 60H follow the front face of the deflecting wall 66, then the rear face of the deflecting wall 66 by turning 180° around the terminal section of the deflecting wall 66, the steaming chamber 60 including, at the edge of the opening 63, two extremity walls 67 which project toward the interior of the steaming chamber 60 and together define an outlet channel communicating with a common extremity of the lateral channels 60G, 60H.

The steaming chamber 60 also advantageously includes two lateral walls 68 arranged symmetrically with respect to the plane P and which extend from the peripheral wall 61 by projecting toward the interior of the steaming chamber 60, the two lateral walls 68 extending obliquely toward the front by making an angle of approximately 45° with respect to the plane P. These two lateral walls 68 are arranged at the height of the extremity wall 67 of the deflecting wall 66 and limit the flow cross section of the lateral channels 60G, 60H by locally reducing their width by half.

The operation of the apparatus thus realized will now be described.

When the user wishes to smooth a garment, he fills the reservoir 10, preferably with water, and then pushes on the start button 4 of the apparatus. The electrical resistor 62 of the heating body 6 is then electrically powered until the steaming chamber 60 reaches the setpoint temperature of the thermostat, the treatment surface 30A then reaching a temperature higher than 100° C. by thermal conduction with the heating body 6.

If the user actuates the trigger 52, this starts up the pump 5 which then injects water into the steaming chamber 60 with a flow advantageously of 10 to 35 gr/min and preferably of approximately 25 gr/min.

This flow is distributed between the two nozzles 50 at the Y-shaped branch of the pipe, such that the water is distributed on the two steaming areas 60A, 60B in order to obtain better distribution of the volume of water injected onto the bottom wall 64 in the steaming chamber 60. This results in a more homogeneous distribution of the calories lost by the heating body 6 to steam the water injected onto the bottom wall 64 and thus a smaller thermal gradient between the various points of the bottom wall 64. Thus, the thermostat controlling the heating body 6 is more often active, which allows optimal input heat to steam the water in the steaming chamber 60 and limits the quantity of liquid water not steamed.

In addition, the steaming chamber 60 realized in this way has shapes that make it possible to trap droplets of water not yet steamed in dedicated areas, and thus prevent them from being carried with the steam flow outside of the steaming chamber 60.

In fact, as illustrated on FIG. 6A, when the steaming chamber 60 is arranged in a lateral position, that is, tilted to one side such that the bottom wall 64 is arranged vertically with one of its lateral edges oriented downwards, the water injected into the steaming chamber 60, and which is not yet steamed, is stored in a front lateral retention tank arranged in front of the retention wall 65A, 65B and a rear lateral retention tank arranged behind the retention wall 65A, 65B. In the particular embodiment example illustrated in the figures, the two retention tanks are advantageously sized to be able to collect a volume of liquid of approximately 2 and 4 $cm^3$, respectively.

The water stored in these retention tanks is progressively steamed by the heat released by the heating body 6, the thermal exchange with this water being promoted by the presence of the lateral wall which projects toward the interior of the steaming chamber 60.

In accordance with the arrows which illustrate, on FIG. 6A, the path of the steam flow in this lateral position of the steaming chamber 60, the steam produced by the steaming of the water injected into the evaporation areas and by the steaming of the water collected in the lateral tank can then escape through the central channel 60E and then through the lateral channel 60G, circumventing the deflecting wall 66 to reach the opening 63 and join the distribution circuit arranged outside the steaming chamber 60. During this travel of the steam, the deflecting wall 66 arranged upstream of the opening 63 has the advantage of avoiding any direct spraying of water droplets through the outlet.

Of course, given the symmetry of the steaming chamber 60 with respect to the longitudinal plane P, the travel of the steam takes place in a similar and symmetrical manner when the steaming chamber 60 is arranged in the lateral position with the other lateral edge oriented downwards.

As illustrated in FIG. 6B, when the steaming chamber 60 is arranged in a vertical position with its front extremity oriented downwards, the steaming chamber 60 has three retention tanks able to store the water that is not yet steamed. The three retention tanks consist of two median tanks formed by the first section of the retention walls 65A, 65B and a front tank formed by the circular front section of the peripheral wall 61.

When the steaming chamber 60 is in this vertical position, the steam can escape freely by following the path illustrated by the arrows to exit through the slot 31 without risk of expulsion of a large quantity of liquid.

As illustrated in FIG. 6C, when the steaming chamber 60 is arranged in a vertical position with its front extremity oriented upwards, the steaming chamber 60 has four retention tanks able to store the water that is not yet steamed. These four retention tanks consist of two steaming areas 60A, 60B and two rear tanks formed on either side of the opening 63 by the extremity wall.

The apparatus thus realized therefore has the advantage of procuring improved performances, the geometry of the steaming chamber allowing the steam-emitting head to be used in substantially all positions without risk of spattering of water.

Of course, the invention is in no way limited to the embodiment described and illustrated, which has been provided only as an example. Modifications are still possible, in particular from the point of view of the composition of the various components or by substitution of equivalent techniques, without departing from the scope of protection of the invention.

Thus, in one embodiment variant not represented, the apparatus may include a series of steam outlet holes in place of the steam-emitting slot.

Thus, in one embodiment variant not represented, the flow of the pump, and thus the flow of steam produced by the steaming chamber, may be controlled by means of a button provided for this purpose.

The invention claimed is:

1. Steam smoothing apparatus including a handle connected to a steam-emitting head including a treatment surface intended for being placed vertically opposite a garment to be smoothed and comprising at least one steam outlet orifice, the steam-emitting head including a heating body comprising a steaming chamber including a bottom wall forming an angle of 45° to 90° with the treatment surface and including an injection system configured to inject liquid into the steaming chamber, wherein the injection system configured to inject liquid comprises at least two nozzles for injecting liquid onto two separate steaming areas of the steaming chamber, wherein the steaming chamber includes a front portion oriented toward the at least one steam outlet orifice and a rear portion opposite the front portion, the steaming chamber including a plurality of wall portions to guide steam generated by each of the two separate steaming areas toward the rear portion of the steaming chamber before steam escapes the steam-emitting head via the at least one steam outlet orifice.

2. The smoothing apparatus according to claim 1, wherein the bottom wall includes a front extremity oriented toward the treatment surface and a rear extremity situated opposite, and wherein the steaming areas are surrounded on a portion of their circumference by a retention wall that forms a cavity in which liquid can be trapped when the bottom wall is tipped vertically toward the rear or vertically to one side.

3. The smoothing apparatus according to claim 2, wherein the steaming chamber is laterally bordered by a peripheral wall and is closed on its upper extremity by a lid attached to the peripheral wall, the lid containing the nozzles.

4. Steam smoothing apparatus including a handle connected to a steam-emitting head including a treatment surface intended for being placed vertically opposite a garment to be smoothed and comprising at least one steam outlet orifice, the steam-emitting head including a heating body comprising a steaming chamber including a bottom wall forming an angle of 45° to 90° with the treatment surface and including an injection system configured to inject liquid into the steaming chamber, wherein the injection system configured to inject liquid comprises at least two nozzles for injecting liquid onto two separate steaming areas of the steaming chamber, wherein the bottom wall includes a front extremity oriented toward the treatment surface and a rear extremity situated opposite, and wherein the steaming areas are surrounded on a portion of their circumference by a retention wall that forms a cavity in which liquid can be trapped when the bottom wall is tipped vertically toward the rear or vertically to one side, wherein the steaming chamber is laterally bordered by a peripheral wall and is closed on its upper extremity by a lid attached to the peripheral wall, the lid containing the nozzles, and wherein the peripheral wall includes an opening establishing communication between the interior of the steaming chamber and a steam distribution circuit in which the steam is diffused to the steam outlet orifice, and wherein the opening is arranged at a rear extremity of the steaming chamber arranged opposite the treatment surface.

5. The smoothing apparatus according to claim 4, wherein the retention wall extends from the peripheral wall toward the interior of the steaming chamber, passing behind the steaming area, then on the side of the steaming area, and finally at least partially in front of the steaming area, but without reaching the peripheral wall, resulting in a passage between one distal extremity of the retention wall and the peripheral wall.

6. The smoothing apparatus according to claim 5, wherein the passages of the steaming areas communicate with a central channel for steam diffusion extending longitudinally to the center of the steaming chamber and wherein the two steaming areas are arranged symmetrically on either side of the central channel.

7. The smoothing apparatus according to claim 6, wherein the central channel discharges opposite a deflecting wall which is arranged opposite the opening, the deflecting wall diverting the steam flow from the central channel toward two lateral steam outlet channels, which extend along the peripheral wall and discharge on either side of the opening.

8. The smoothing apparatus according to claim 4, wherein the steaming chamber includes, at the edge of the opening, two extremity walls that project toward the interior of the steaming chamber.

9. The smoothing apparatus according to claim 1, wherein the steaming chamber projects in the middle of an enclosure of the heating body, the enclosure defining a distribution circuit around the steaming chamber.

10. The smoothing apparatus according to claim 9, wherein the treatment surface is borne by an extremity plate arranged at a longitudinal extremity of the head, and wherein the heating body includes a front face which comes into contact with the extremity plate, the front face comprising a port putting the steam outlet hole of the treatment surface into communication with the enclosure of the heating body.

11. The smoothing apparatus according to claim 1, wherein the two nozzles inject liquid onto two separate steaming areas of the bottom wall of the steaming chamber.

12. The smoothing apparatus according to claim 1, wherein the two nozzles are arranged symmetrically on either side of a median plane P perpendicular to the front face and to the bottom wall of the steaming chamber.

13. The smoothing apparatus according to claim 12, wherein the assembly of the steaming chamber is symmetrical with respect to the plane P.

14. The smoothing apparatus according to claim 1, further comprising a portable housing comprising the head, the handle and a liquid reservoir, the steaming chamber being supplied with liquid from the reservoir by means of a pump integrated in the housing.

15. The smoothing apparatus according to claim 14, wherein the pump is an electric pump.

16. The smoothing apparatus according to claim 1, wherein the plurality of wall portions include at least two wall portions that define between them a steam channel extending between the two separate steaming areas, and wherein steam generated by each of the two separate steaming areas flows via said steam channel toward the rear portion of the steaming chamber.

17. The smoothing apparatus according to claim 1, wherein the bottom wall includes a plurality of projecting studs, said projecting studs provided inside and outside the steaming chamber.

* * * * *